US005986526A

United States Patent [19]

Kopal et al.

[11] Patent Number: 5,986,526

[45] Date of Patent: Nov. 16, 1999

[54] RF MICROWAVE BELLOWS TUNING POST

[75] Inventors: Josef Kopal, Pointe Claire; Gérard Sénéchal, Sta-Anne-de-Bellevue; André Bouvrette, Perrot; Jean-Michel Lévesque, Pierrefonds, all of Canada; Kanti Patel, Newtown, Pa.; Christopher Yong, Isle Bizord; Yves Patenaude, Ste-Anna-de-Bellevue, both of Canada; Alexander Csaki, Beaconsfield, Canada; Yvan Côté, Bobsbriand, Canada; Gérard Carrier, Lachine, Canada; Serge Samson, Deux-Montagnes, Canada

[73] Assignee: EMS Technologies Canada, Ltd., Quebec, Canada

[21] Appl. No.: 08/810,293

[22] Filed: Mar. 3, 1997

[51] Int. Cl.[6] ..... H01P 7/06

[52] U.S. Cl. ..... 333/232; 333/209; 333/235

[58] Field of Search ..... 333/223–226, 333/229, 231–235, 209

[56] References Cited

U.S. PATENT DOCUMENTS

| | | | |
|---|---|---|---|
| 2,103,515 | 12/1937 | Conklin et al. | 333/234 |
| 2,124,029 | 7/1938 | Conklin et al. | 333/234 |
| 2,205,851 | 6/1940 | Hansell | 333/234 X |
| 2,286,408 | 6/1942 | Hansell | 333/234 |
| 4,521,754 | 6/1985 | Ranghelli et al. | 333/234 X |
| 4,651,057 | 3/1987 | Uetomi et al. | 333/231 X |
| 5,754,084 | 5/1998 | Hietala | 333/232 X |

FOREIGN PATENT DOCUMENTS

| | | | |
|---|---|---|---|
| 2-219303 | 8/1990 | Japan | 333/235 |

*Primary Examiner*—Seungsook Ham
*Attorney, Agent, or Firm*—Cobrin & Gittes

[57] ABSTRACT

An adjustable RF microwave tuning post for use in an RF cavity is disclosed. It is comprised of a flexible integrally-formed hollow tuning post disposed in the RF cavity. A drive shaft extending internally of the tuning post is provided to vary the dimensions of the tuning post. The drive shaft is connected to the tuning post at the top end thereof and connected at the other end of the drive shaft to an adjusting nut. The tuning post is made flexible by the use of bellows, which in a preferred embodiment of the invention is located along the side walls thereof.

23 Claims, 9 Drawing Sheets

RF MICROWAVE BELLOWS TUNING POST

FIELD OF THE INVENTION

This invention relates to microwave devices but more particularly to an adjustable tuning post for use in a microwave cavity.

BACKGROUND OF THE INVENTION

Adjustable tuning posts disposed in a microwave cavity have been used in a number of radio frequency (RF)/microwave components, such as waveguides, TEM-lines, RF filters, resonators, etc.

Generally, the adjustment of a tuning post within an RF cavity will change the electrical characteristics of the microwave device.

High-power filters which make use of tuning posts have been used for a number of years for space applications, satellites, for examples. Unfortunately, because of the power requirements as well as the wide range of operating temperatures common to space applications, filters with adjustable tuning posts have been found to cause a number of problems.

For example, even if filter components are fixed, the metals used in filters, such as aluminum, expand and contract with the large temperature changes common in space applications, thereby modifying the filter behaviour and rapidly limiting its performance capability. In addition to meeting the thermal requirements of space applications, microwave components must often be designed to take into account problems associated with the effects of Multipaction, and Passive Intermodulation Interference (PIM).

The Multipactor effect is a vacuum discharge produced by an RF field between a pair of surfaces. Electron multipaction (avalanche) is by secondary electron emission from these surfaces. For multipaction breakdown to occur, the pressure must be sufficiently low so that the mean free path is longer than electrode separation distance. Thus, electrons can readily travel between the electrodes without undergoing collisions with gas molecules. When these electrons collide with the electrodes, they release secondary electrons provided that the primary electron possesses sufficient energy and that the electrode surfaces have a secondary emission coefficient greater than one. If this occurs as the electric field passes through zero, the reversed electric field will accelerate the electrons back across the gap. If the transit time of the electrons across the gap is one half the cycle of the RF field, the secondary electrons formed by the initial electrons become primary electrons for the next half cycle to form another group of secondary electrons. In this way, large electron densities rapidly build up in the gap and breakdown results.

Another problem encountered in space applications is the risk of interference due to PIM, especially for multichannel communication systems for which the RF output power level has significantly increased over the years.

It is well-known that harmonics and intermodulation (IM) products are generated when two or more signals are applied to a nonlinear circuit element. In a practical communication system, the harmonics and intermodulation products generated by the high-power amplifiers are effectively filtered out using output transmit filters. For mobile satellite applications, a very high transponder gain is required and high-rejection output filters providing, for example, some 100 dB suppression in the receive band are needed.

Passive components and materials used in communication satellites can exhibit nonlinear voltage/current characteristics and can generate harmonics and intermodulation products. Since these spurious signals are generated by passive components, the term Passive Intermodulation (PIM) is attributed to such spurious signals. Although these signals are produced at very low levels, the PIM signals falling into the receive frequency band can cause serious interference problems if they are generated after the output high-rejection filters in the antennas or by surrounding structures on the spacecraft, and if they are picked up by the communication system.

PIM performance is very critical for mobile satellite applications. Due to the low frequency of operation (UHF, L-Band or S-Band), waveguide technology leads to unacceptably large and heavy components, and coaxial technology must be used instead. However, very high current densities, which enhance the risk of PIM generation, exist on the centre conductor of coaxial structures.

Metal-insulator-metal (MIM) junctions that are exposed to multi-carrier signals can result in nonlinear behaviour which can cause PIM. These junctions are caused by oxides forming between metallic surfaces. Rough surfaces can prevent a good metal-to-metal contact and can also create nonlinear junctions that cause PIM. Very high-pressure contacts, or else noncontacting interfaces using dielectric insulators, are mandatory to reduce the risk of PIM. This is particularly critical at the mating interfaces of coaxial high-power components, for which a good contact must be maintained over a wide operating temperature range. Such devices include, for example, coaxial quarter-wave microwave filters.

DESCRIPTION OF THE PRIOR ART

A filter which makes use of an adjustable tuning post is disclosed in U.S. Pat. No. 4,521,754 of Ranghelli et al.

The Ranghelli et al microwave resonator includes an enclosed resonator housing and a hollow central conductor having one end fastened to the bottom of the resonator housing and extended toward the top wall of the resonator housing. The other end of the central conductor is spaced from the top wall and includes an adjustable bellows assembly disposed coaxial of a longitudinal axis of the central conductor. A non-rotating, axially movable drive shaft is disposed coaxial of the axis of the central conductor within the central conductor. One end of the drive shaft is fastened to the bellows assembly and the other end of the drive shaft is coupled to a drive means disposed in the bottom wall to cause axial movement of the drive shaft to adjust the axial length of the bellows assembly and, hence, the axial length of the central conductor to adjust the resonant frequency of the microwave resonator. The housing and the central conductor are made from a first selected coefficient of thermal expansion and the drive shaft is made from a second selected coefficient of thermal expansion. The first and second coefficients of thermal expansion are selected to minimize resonant frequency drift due to temperature variations and, hence, provides temperature compensation for the microwave resonator.

The problem associated with using the Ranghelli tuning post design is that it is not free of passive intermodulation interference. In particular, the Ranghelli design makes use of a post assembly with several components which, when assembled, introduce many metal-to-metal interfaces by design. This type of design is therefore workmanship sensitive. That is, any manufacturing or workmanship flaws, such as burrs created during assembly of parts, increase the likelihood of PIM. For example, there are no less than four metal-to-metal interfaces in the Ranghelli et al design; one between the screw and the post's end cap, one between the top end cap and the bellows top end, another between the bellows bottom end and the bottom end cap and a fourth between the bottom end cap and post housing. Because several parts of this assembly are in the RF field and assembled inside the resonator, the metal-to-metal interfaces of the various elements can potentially form a major source of PIM interference. In addition, by its inherent design, the Ranghelli tuning post has to be assembled from inside the cavity.

Therefore, a need exists for an adjustable RF microwave tuning post which eliminates the aforementioned problems.

Accordingly, it is an object of the present invention to provide an adjustable RF microwave tuning post which is integrally formed in a one-piece housing.

Another object of the present invention, is to provide an adjustable RF microwave tuning post which is integral with the chassis of the RF cavity.

Another object of the present invention is to provide an adjustable RF microwave tuning post which is flexible and provided with integrally-formed bellows wherein the dimension of the tuning post can be adjusted externally of the cavity.

Accordingly, in accordance with an aspect of the present invention there is provided an adjustable RF microwave tuning post for use in an RF cavity provided in a chassis, comprising:

a flexible integrally-formed hollow tuning post disposed in said RF cavity and having a continuous conductive body free of any seam or joint; and means for varying and controlling the dimensions of said tuning post in said RF cavity, said varying means being disposed externally of said RF cavity. In this way, the conductive body of the tuning post generates little or no passive intermodulation (PIM) interference as a result of being integrally-formed and being free of any seam or joint.

The advantages of the adjustable RF microwave tuning post in accordance with the principles of the present invention are the improved thermal stability and performance of the RF cavity over a wide temperature range. Temperature limiting materials inside the cavity are eliminated and since there is no dielectric penetrating the cavity, the electrical losses are reduced significantly. Outgassing problems are eliminated along with the risk of corona, thereby minimizing the need for thermal analysis. The design assembly of the tuning post does not involve tedious and workmanship-critical operations thereby reducing the risk of passive intermodulation interference. In addition, since the dimensions of the tuning post can be varied externally of the RF cavity, there is no need for exotic (non-metallic) materials inside the cavity, thereby improving Multipactor characteristics of the cavity. In addition, the elimination of separate components reduces significantly the mass of the RF cavity.

DESCRIPTION OF THE PREFERRED EMBODIMENTS

Figure 1:
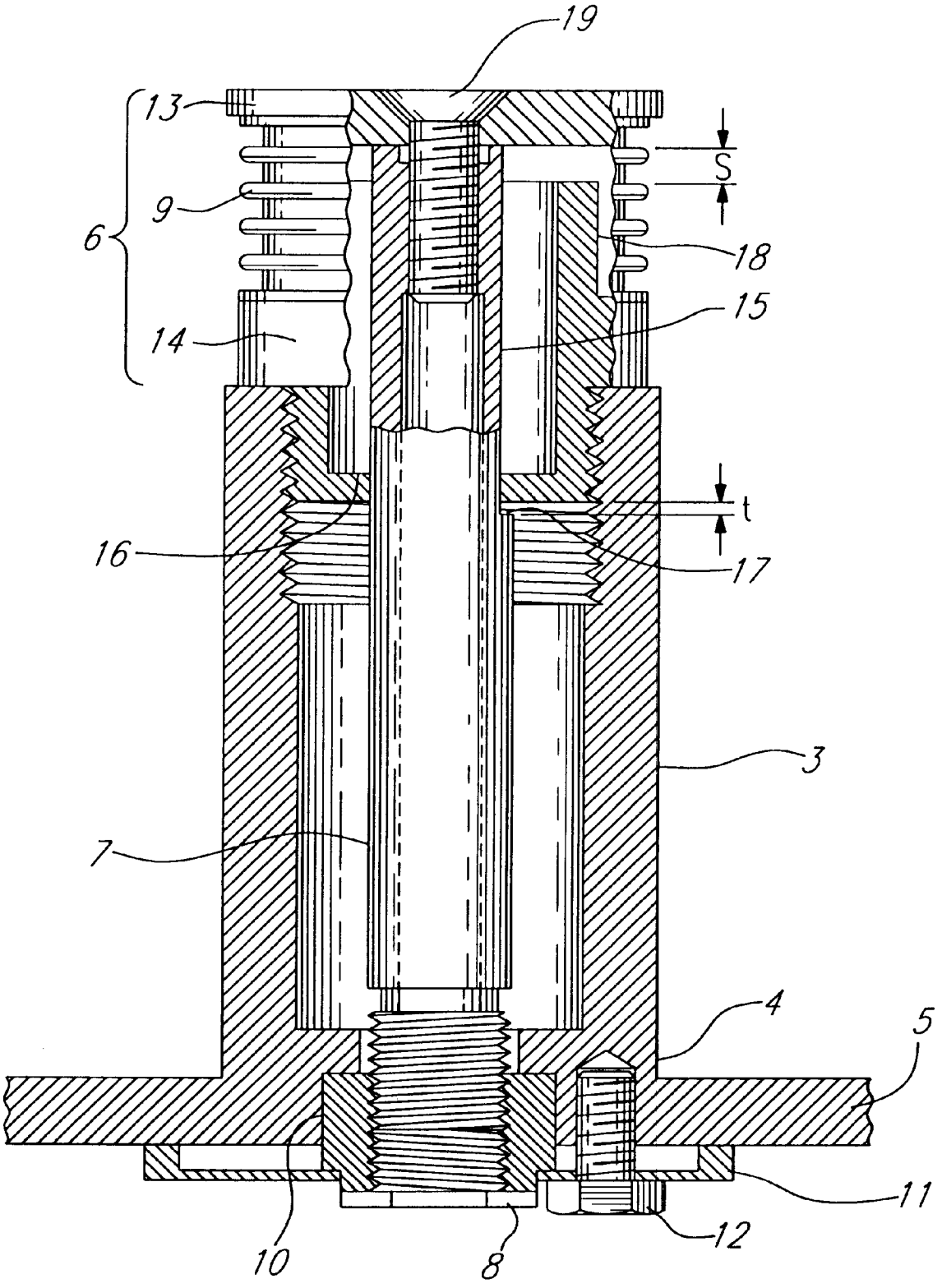
FIG. 1 is a longitudinal cross sectional view illustrating a prior art microwave resonator tuning post.
Figure 2:
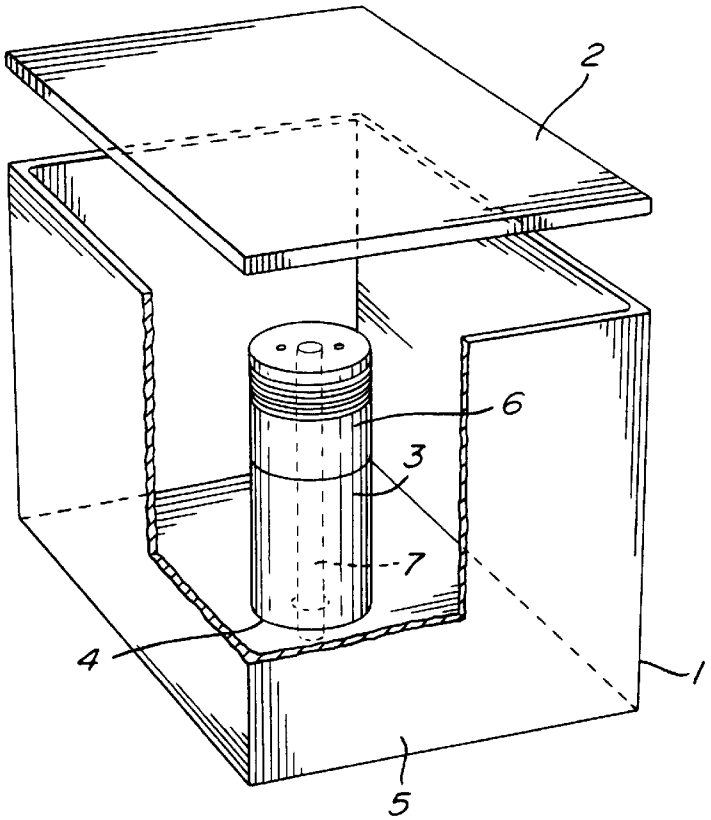
FIG. 2 is a perspective partially exploded and partially cut away view illustrating a prior art microwave resonator.

Referring now to FIG. 1, we have shown a longitudinal cross sectional view illustrating a microwave resonator tuning post according to the prior art. FIG. 2 shows a perspective and partially sectioned view of a microwave resonator making use of the tuning post of FIG. 1.

Referring to FIGS. 1 and 2, the tuning post includes a central conductor 3 having one end 4 fastened to the bottom 5 of the cavity housing. Central conductor 3 extends toward the top wall or cover 2 of the cavity housing 1. The other end of the central conductor 3 includes thereon an adjustable bellows assembly 6 disposed coaxial of a longitudinal axis of the central conductor 3. A drive shaft 7, which is non-rotating but axially movable, is disposed coaxial of the longitudinal axis of and within the central conductor 3 with one end of the drive shaft 7 being fastened to the bellows assembly 6 and the other end of the drive shaft 7 being coupled to a drive means, such as drive shaft nut 8 to cause axial movement of drive shaft 7, thereby adjusting the axial length of the bellows assembly 6 and, hence, the axial length of the central conductor 3 to adjust the resonant frequency of the resonant cavity.

As indicated previously, the problem associated with prior art designs such as described above, is that they are not free of passive intermodulation interference. As illustrated in FIG. 1, the tuning post design makes use of a post assembly with parts that introduce many metal-to-metal interfaces by design. For example, there are at least four metal-to-metal interfaces in the above described design; one between the screw 19 and the post's end cap 13, one between the top end cap 13 and the top end of bellows 9, another between the bellows bottom end and the bottom end cap 14 and a fourth between the bottom end cap 14 and post or central conductor 3. Because several parts of this assembly are in the RF field and assembled inside the resonator, the metal-to-metal interfaces of the various elements can potentially form a major source of PIM interference. As indicated above, since the tuning post is partially assembled from inside the cavity, the tuning post design is inherently workmanship sensitive.

Figure 3:
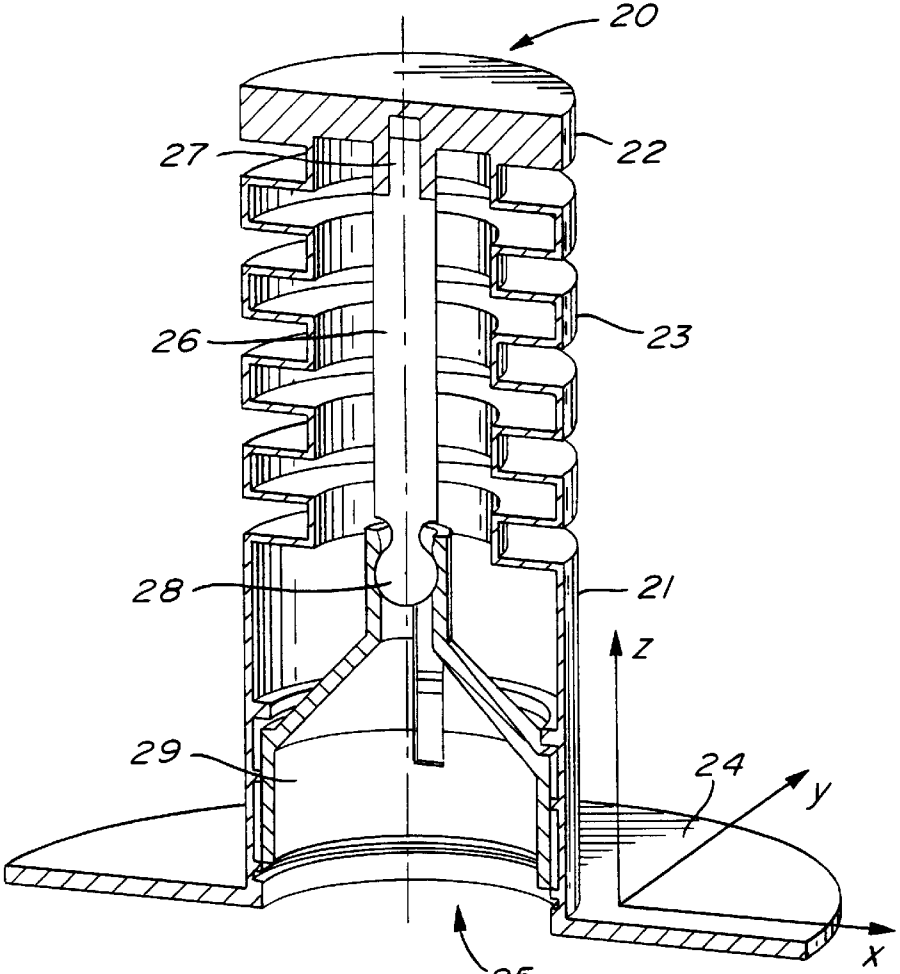
FIG. 3 is a longitudinal cross sectional view illustrating the adjustable microwave tuning post in accordance with the principles of the present invention.

Referring to FIG. 3, there is illustrated therein an adjustable RF microwave tuning post wherein the base, lower end, flexible portion and top end of the post are all integrally formed and the post adjustment assembly is entirely disposed externally of the RF cavity. As illustrated in FIG. 3, the flexible integrally-formed tuning post eliminates the assembly of components which would normally introduce metal-to-metal contact between parts which, when located inside the RF cavity, could cause passive intermodulation interference. The use of an integrally-formed tuning post also minimizes workmanship flaws which can be introduced in multi-part designs. The tuning post 20 comprises a lower end 21, top end 22 and a flexible portion 23 which in the embodiment of FIG. 3 comprises bellows. Each element is integrally formed to eliminate metal-to-metal contacts known to cause PIM. A base 24 which is also integrally formed with the lower end 21 of the tuning post supports the tuning post in the RF cavity. The characteristics of the tuning post can be varied according to the dimension and spacing, cross-sectional shape, material and number of bellows used. In addition, as will be described below, the interior of the tuning post can be filled with a gas or liquid to help control temperature variations of the tuning post.

In the embodiment of FIG. 3, the post adjustment assembly 25 is mechanically driven. That is, the tuning post can be extended and retracted axially thereof using a drive shaft 26 extending at one end 27 to the interior side of the top end of tuning post 22 and is secured at the other end 28 using a ball joint assembly to an adjusting nut 29 which can be rotated to adjust the length of the tuning post without having to access the interior to the RF cavity. Drive shaft 26 may be hollow, fixed or rotatable. Since the tuning post is completely integrally-formed, the drive shaft 26 may rotate freely inside the post without imposing unacceptable torsional stress on the bellows portion.

Figure 4:
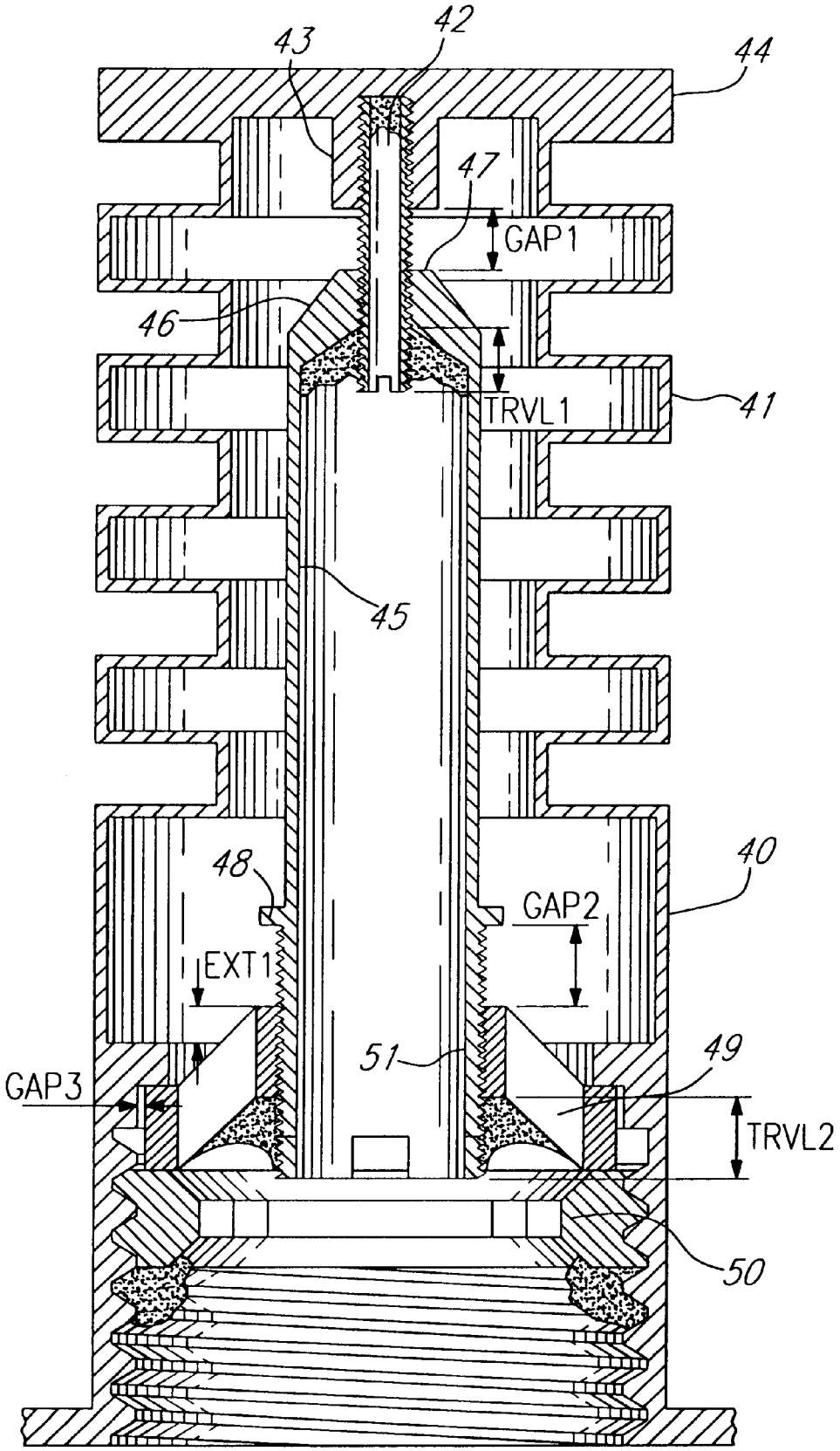
FIG. 4 is a longitudinal cross sectional view illustrating the adjustable microwave tuning post in accordance with the preferred embodiment of the invention.

FIG. 4 is a longitudinal section of a mechanical drive mechanism according to the preferred embodiment of the invention. As in the design of FIG. 3, this tuning post design is also comprised of an integrally formed conductor 40 with bellows 41. This mechanical drive provides several advantages over those of the prior art. The drive mechanism is comprised of a set screw 42 threadedly secured to a sleeve 43 at the top end 44 of the conductor 40. The set screw is preferably fixed in place using a suitable epoxy glue. The set screw 42 is also preferably hollow to permit air to escape sleeve 43 when the set screw 42 is threaded into the sleeve. A hollow piston 45 provided with a truncated cone shaped head 46 is threadedly secured to set screw 42. The truncated cone shaped head 46 forms a flat surface 47 onto which sleeve 43 can abut when the tuning post is in its fully extended position. Thus, surface 47 and sleeve 43 form a mechanical stop when the tuning post is extended. This prevents the bellows 41 from being subjected to mechanical stresses beyond the elasticity of the aluminum used in making the tuning post.

At its lower end, piston 45 is provided with an annular flange 48 which also acts as a mechanical stop against the upper edge of cone shaped tuning nut 49. Tuning nut 49 and flange 48 would abut each other when the tuning post is fully retracted. Tuning nut 49 is threaded to the lower end of piston 45 but is secured inside the tuning post by means of lock nut 50.

The drive mechanism provides a differential thread system to facilitate assembly as well as tuning, without the risk of damaging the tuning post assembly. For example, the set screw is provided with a smaller thread pitch than the interior thread 51 of tuning nut 49. Therefore, one rotation of the tuning nut results in a fractional rotation of the piston with respect to set screw 42. The tuning post can therefore be adjusted much more precisely while at the same time, prevent an overstress of components during the tuning step. The physical geometry of the bellows, tuning post and drive mechanism is chosen according to particular design requirements.

Figure 5C:
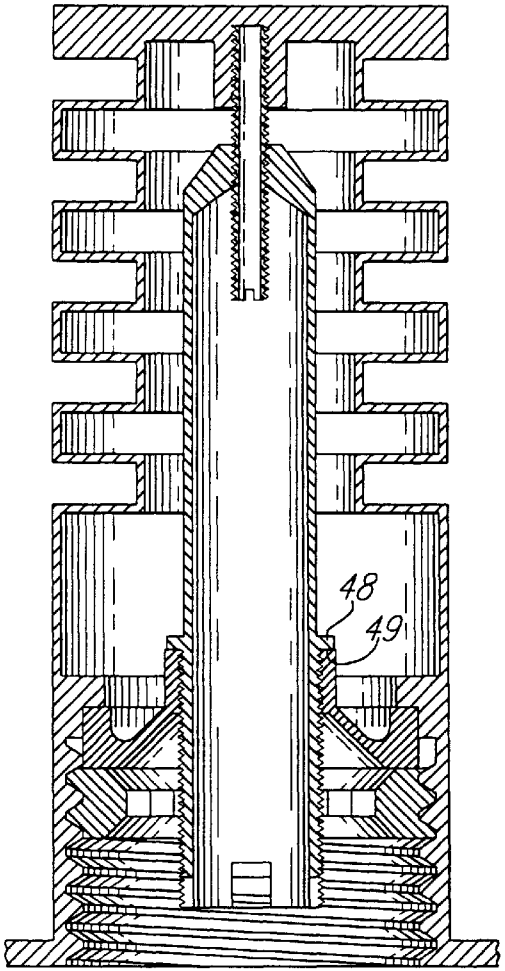
FIGS. 5*a*–5*c* are cross sectional views illustrating the operation of the adjustment mechanism of the embodiment of FIG. 4.
Figure 5B:
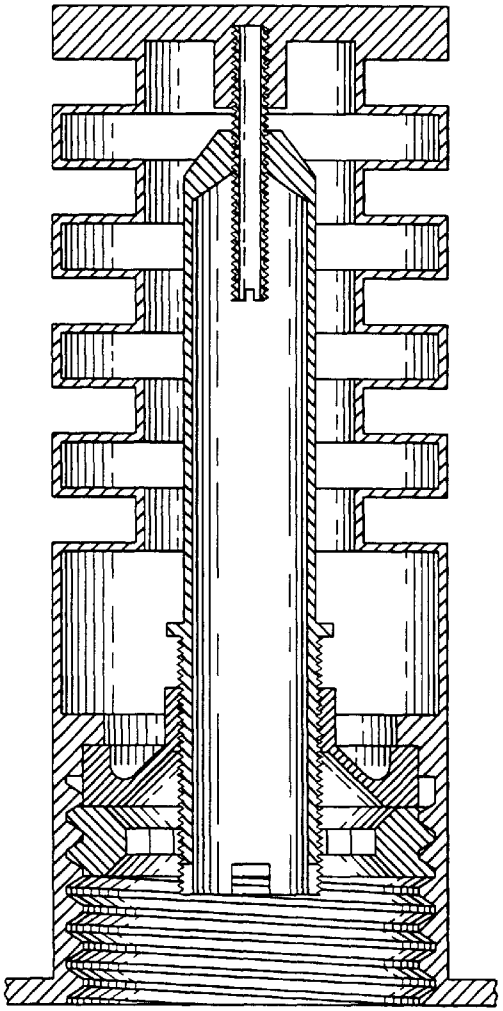
Figure 5A:
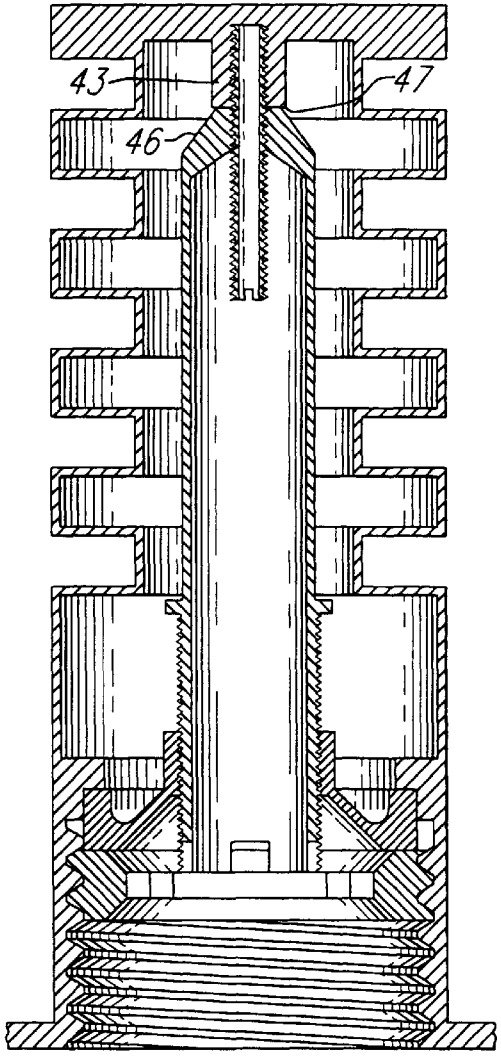

FIGS. 5*a*–5*b* illustrate the functional range of adjustments for the drive mechanism of FIG. 4. In particular, FIG. 5*a* shows the tuning post in a fully extended position with the flat surface 47 of piston head 46 abutting sleeve 43. FIG. 5*b* shows the tuning post is a nominal position, whereas FIG. 5*c* shows the tuning post in its fully retracted position wherein flange 48 abuts the top of tuning nut 49.

If necessary, the mechanically driven post adjustment assembly may be eliminated and replaced with a pneumatic, hydraulic, electromechanical adjustment mechanism. Similarly, the dimension of the post may be changed thermally using the known characteristics of the metals used. Increasing or decreasing the amount of a gas or liquid within the hollow post could be used to stretch and contract the post radially, axially and/or laterally thereof. The ability to vary the dimensions of the post externally of the cavity can be especially important in space applications since changes to the electrical characteristics of the RF cavity could be done remotely, i.e. from an earth station.

In the embodiment illustrated in FIGS. 6*a* to 6*d*, the use of bellows along the side walls of the post 60 is replaced instead with a bellowed or a flexible corrugated top end 61. Axial movement of a drive shaft, changes the dimension of the top end 61.

Figure 6A:
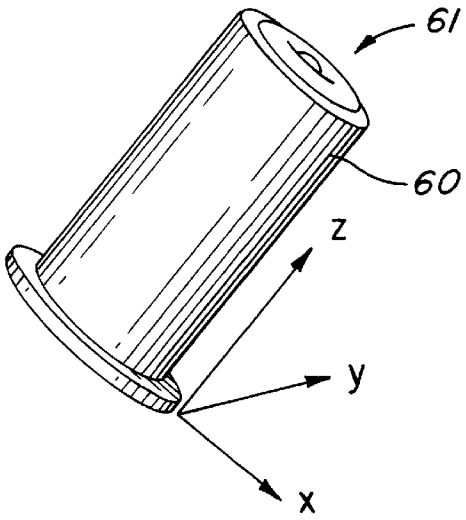
FIGS. 6*a* to 6*d* are perspective and sectional views illustrating the adjustable RF microwave tuning post in accordance with another embodiment of the present invention.
Figure 6B:
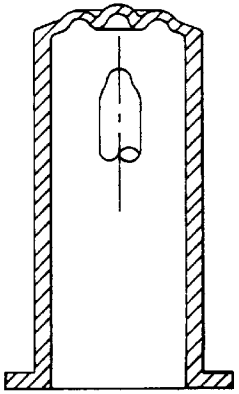
Figure 6C:
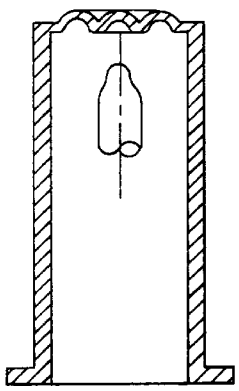
Figure 6D:
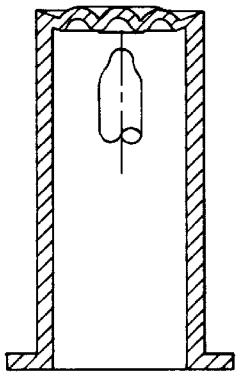

As shown in FIGS. 6*b* to 6*d*, the dimension and in particular the length of the tuning post 60 can be changed using the post adjusting assembly of FIGS. 3 and 4 to vary the shape of the top end 31 of the post. In FIG. 6*b*, when the piston is extended axially in the positive Z dimension, the top end is pushed outwardly to become generally convex. In FIG. 6*c*, the top end is generally level whereas in FIG. 6*d* the top end becomes concave when the shaft is retracted in the negative Z direction. (It should be noted that the deformation of the tuning posts as illustrated in the figures which follow is exaggerated to illustrate the concepts presented in the figures. The actual deformation made to the tuning post would be correspondingly less.)

Figure 7A:
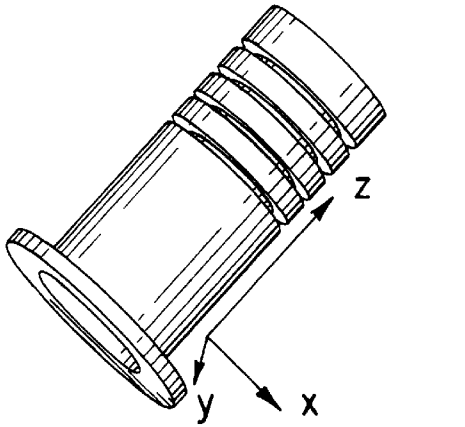
FIGS. 7*a* to 7*d* are perspective and sectional views illustrating the adjustable RF microwave tuning post in accordance with another embodiment of the present invention.
Figure 7B:
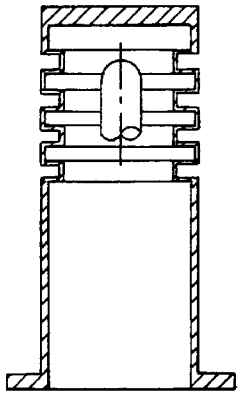
Figure 7C:
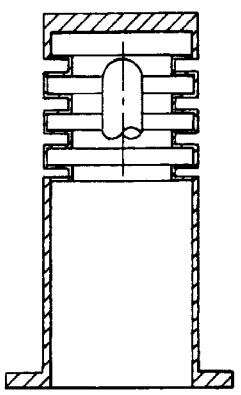
Figure 7D:
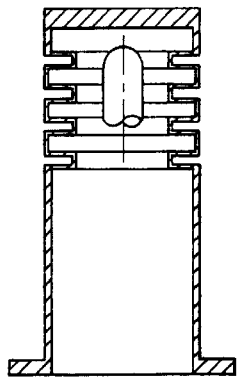

The tuning post of FIGS. 7*a* to 7*d* is similar to the tuning post arrangement of FIGS. 3 and 4 wherein the flexible portion of the post is comprised of bellows along the side walls thereof. In FIG. 7*b*, the tuning post is extended; in FIG. 7*c*, the tuning post is shown in its normal or rested position, whereas in FIG. 7*d* the bellows are compressed when the shaft of the adjusting assembly is axially retracted.

In the embodiment of FIGS. 8*a* to 8*d*, the tuning post is cylindrical in shape and does not make use of bellows but rather is provided with a flexible flat top end. That is, the dimension of the tuning post is adjusted by changing the shape of the top end of the post from a convex configuration in FIG. 8*b* to a concave configuration in FIG. 8*d*.

Figures 8A, 8B, 8C, 8D, 9A, 9B, 9C, 9D:
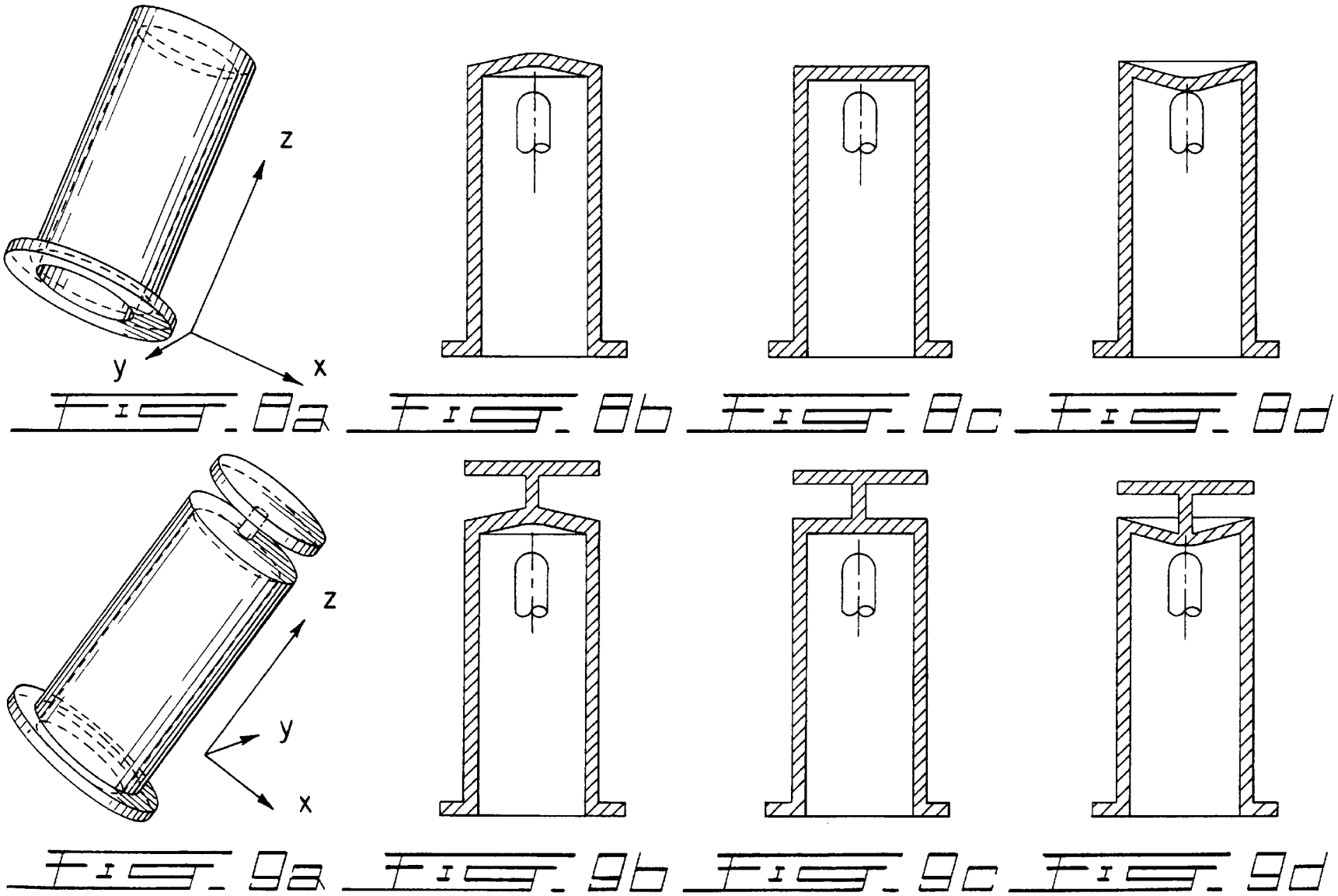
FIGS. 8*a* to 8*d* are perspective and sectional views illustrating the adjustable RF microwave tuning post in accordance with another embodiment of the present invention.
FIGS. 9*a* to 9*d* are perspective and sectional views illustrating the adjustable RF microwave tuning post in accordance with another embodiment of the present invention.

In the embodiment of FIGS. 9*a* to 9*d*, the tuning post is also cylindrical in shape and is provided with a flexible flat plunger type top end. In this embodiment the dimension of the tuning post is adjusted over a wider range since the entire top surface of the plunger is moved, as opposed to changing the shape of the top end of the post as shown previously, from a convex configuration in FIG. 8*b* to a concave configuration in FIG. 8*d*. In FIG. 9*b*, the effective length of the post is increased with a slight deformation of the post's top end, whereas in FIG. 9*d*, the effective length of the post is shorten. The use of a plunger type top end thus maximizes the tuning effect of the post.

Figures 10A, 10B, 10C, 10D, 11A, 11B, 11C, 11D:
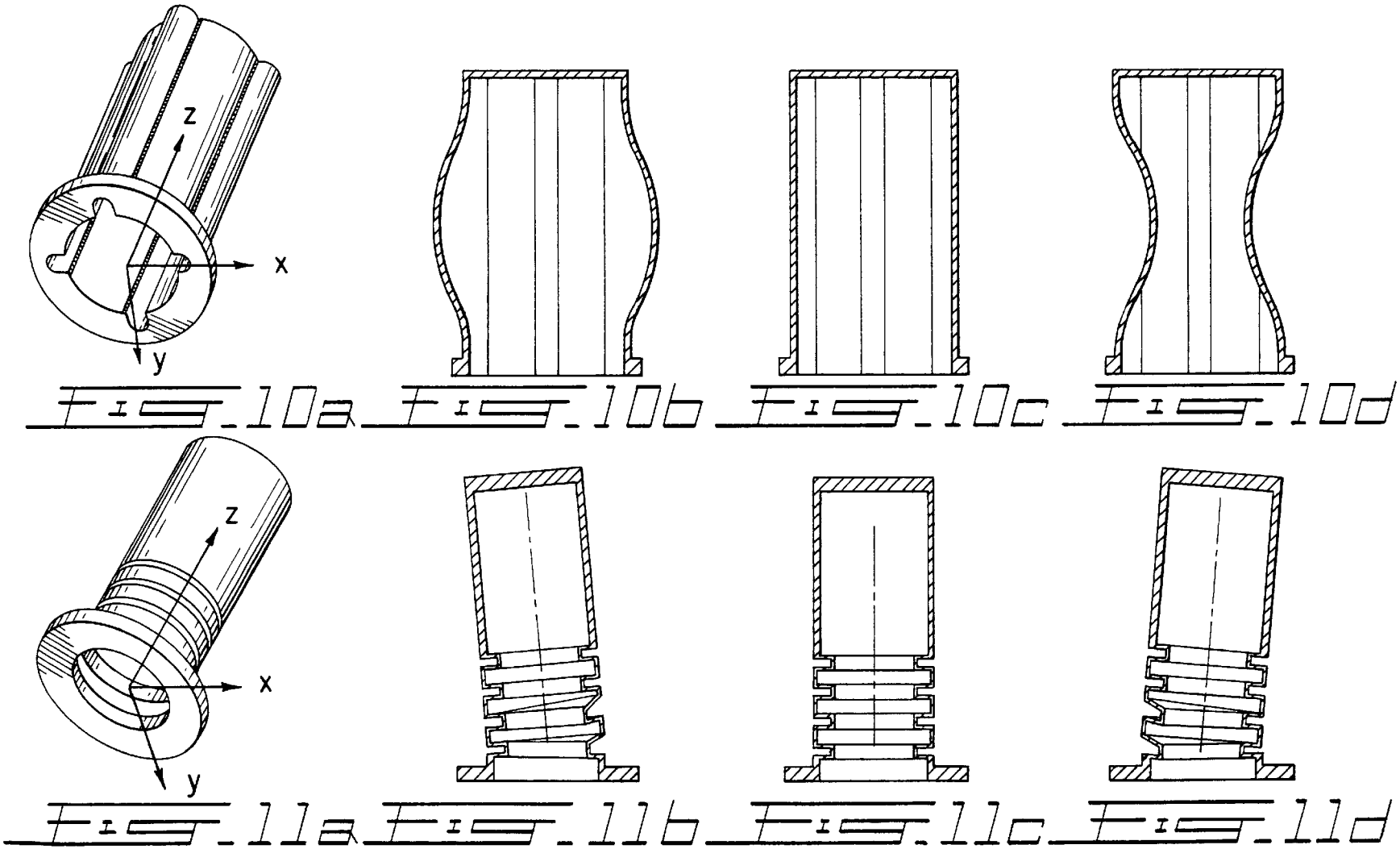
FIGS. 10*a* to 10*d* are perspective and sectional views illustrating the adjustable RF microwave tuning post in accordance with another embodiment of the present invention.
FIGS. 11*a* to 11*d* are perspective and sectional views illustrating the adjustable RF microwave tuning post in accordance with another embodiment of the present invention.

In the embodiment of FIGS. 10*a* to 10*d*, the tuning post is provided with a series of longitudinal bellows which permit the post to stretch radially inwardly such as shown in FIG. 10*d* or radially outwardly such as shown in FIG. 10*b*.

In the embodiment of FIGS. 11*a* to 11*d*, the flexible portion of the tuning post is located at the bottom end of the post near the base thereof. In the embodiment of FIGS. 11*a*–11*d*, bellows are used to permit lateral movement of the tuning post (or axially as described for FIGS. 7*a*–7*d*).

Figure 12:
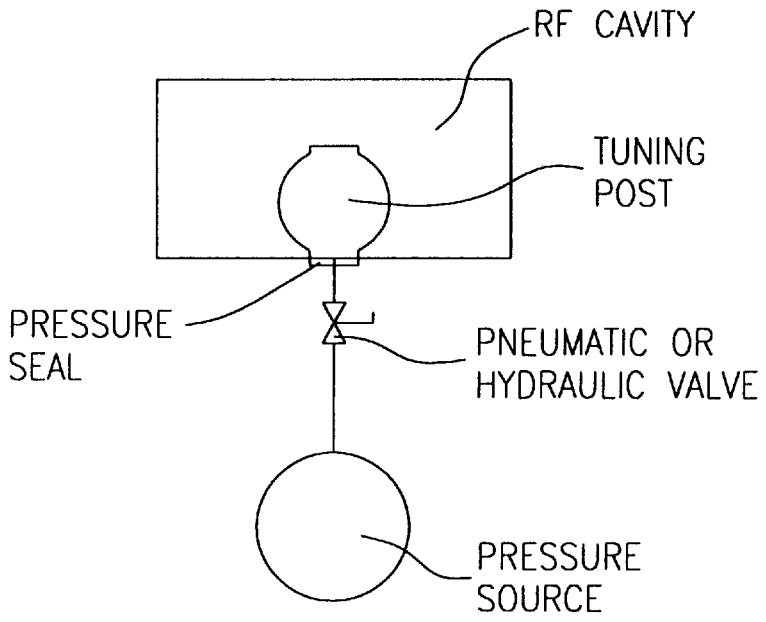
FIG. 12 is a schematic representation illustrating the manner of operating the embodiments of FIGS. 10*a*–10*d*.

FIG. 12 is a schematic representation of the tuning post of FIGS 10*a*–10*d* within an RF cavity and driven by a vacuum pressure source. As shown, a pneumatic or hydraulic valve is arranged in line between the vacuum pressure source and a pressure seal that seals the bottom open end of the tuning post to the RF cavity wall.

By opening the valve, pressure from the pressure source is applied to the interior of the tuning post, causing its side walls to deform as desired into one of the three states depicted in FIGS. 10*a*–10*d*. The pressure source may evacuate the interior, causing the side walls to deform inwardly as shown in FIG. 10*d*. or may increase the pressure of the interior, resulting in the side walls deforming outwardly as shown in FIG. 10*b*. FIG. 10*c* represents and intermediate configuration. The side walls are of such greater length that the width of the end wall that they are more apt to deform under pressure. If necessary, the end wall may be thicker to render the post stronger.

Figure 13:
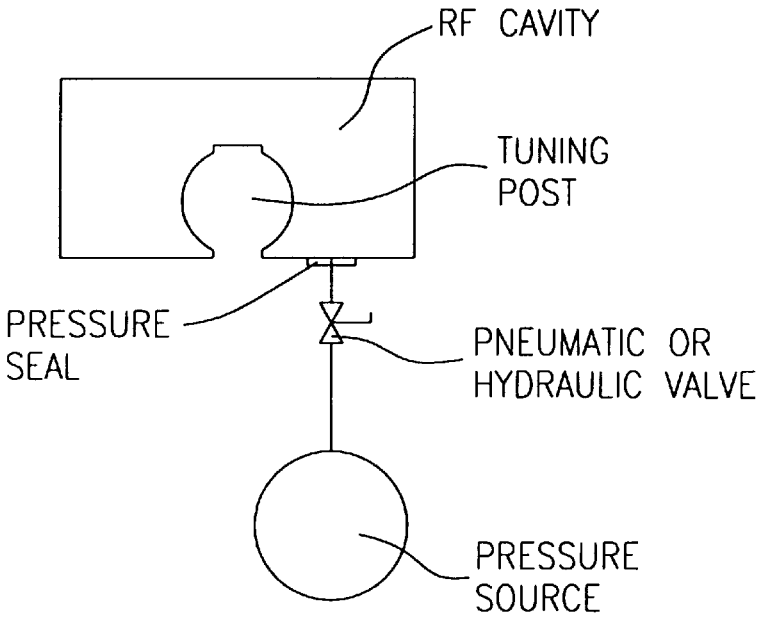
FIG. 13 is a schematic representation of a further embodiment illustrating the manner of operating the embodiment of FIGS. 10*a*–10*d*.

FIG. 13 is an alternative embodiment to that of FIG. 9 in that evacuation or pressurization is applied to the RF cavity directly instead of to the interior of the tuning post, which is pressure sealed from the RF cavity. The operation is opposite to that of FIG. 12 in the sense that evacuation of the RF cavity causes the side walls of the tuning post to deform outwardly as in FIG. 10*b* and pressurizing the RF cavity causes the sidewalls of the tuning post to deform inwardly as in FIG. 10*d*. If necessary, the end wall may be thicker to render the post stronger.

Figure 14:
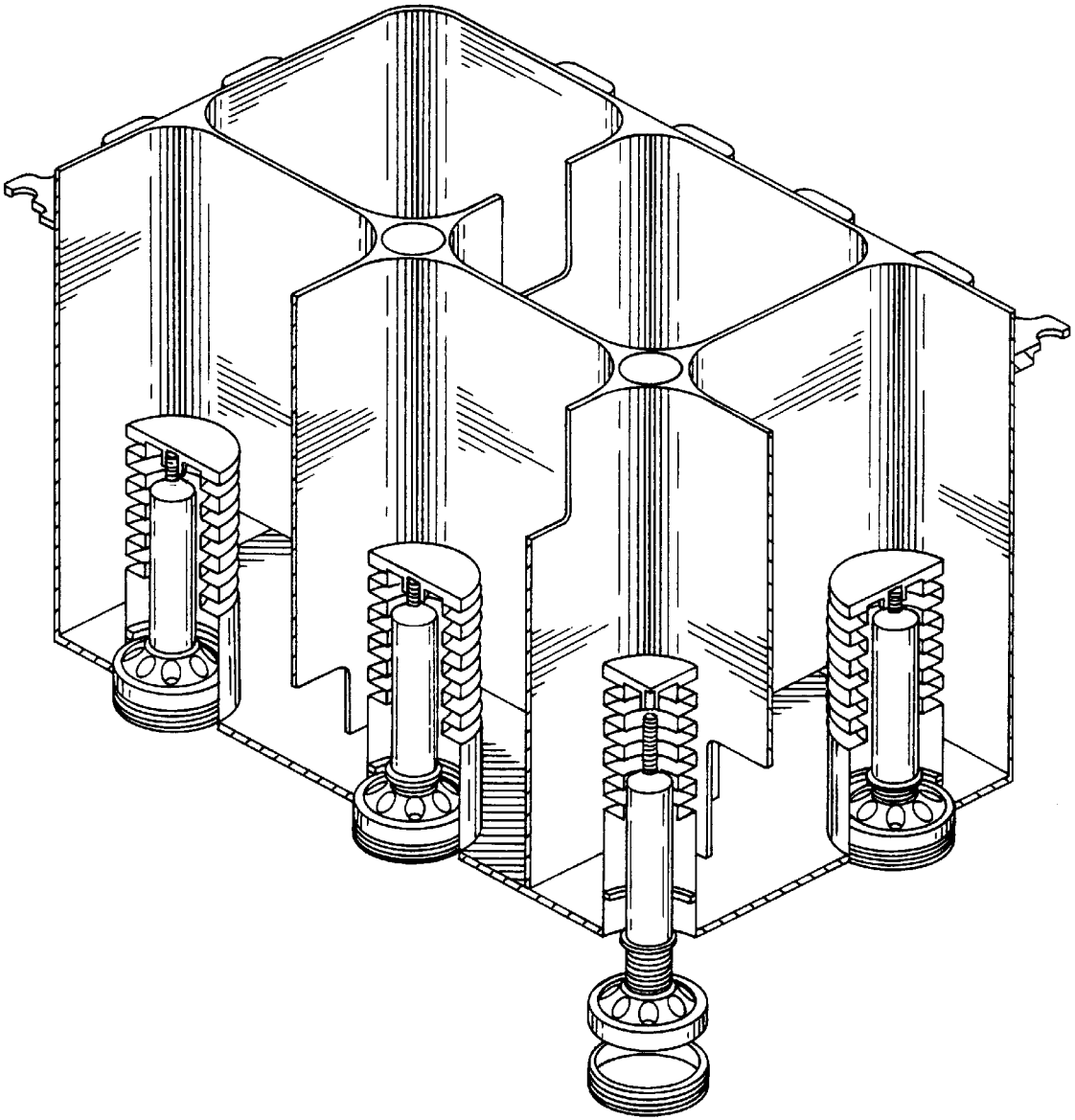
FIG. 14 is a perspective and sectional view of a microwave resonator cavity in accordance with the principles of the present invention.

FIG. 14 is a sectional view of an RF cavity making use of the integrally formed tuning posts of the present invention. The RF cavity of FIG. 14 can be milled from a block of aluminum so as to form six individual tuning posts with integrally formed bellows as shown. It will be known to those knowledgeable in the art that these cavities can be milled using Computer Numerically Controlled (CNC) milling machines and/or conventional or CNC probe/plunge Electro Discharge Machine (EDM). The RF cavity of FIG. 14 is milled out of a solid block of aluminum to form six cavities, each with its own tuning post. Once formed, the drive mechanism is inserted in each tuning post. As shown, contrary to prior art cavities, assembly is done externally of the cavities. As illustrated in FIG. 4 and 14, first the set screw is threaded in the sleeve of the tuning post's top end. Then the piston is threaded onto the set screw and set in place using the tuning nut and locking nut. Once the ideal electrical characteristics of the cavity are obtained, all components are locked in place as shown in FIG. 4 using strapping or epoxy. In order to maintain tuning accuracy, the set screw, piston and tuning nut are all made of invar. The tuning post and locking nut are made of aluminum.

What is claimed is:

1. An adjustable RF microwave tuning post for use in an RF cavity; comprising:

a chassis bounding the RF cavity;

an integrally-formed hollow tuning post disposed in said RF cavity and having a continuous conductive body free of any seam or joint;

means for varying and controlling dimensions of the tuning post in said RF cavity whereby said conductive body of said post reduces passive intermodulation (PM) interference as a result of being integrally-formed and being free of any seam or joint; and wherein said tuning post is integrally formed with the chassis of said RF cavity and free of seams or joints where the tuning post and the chassis join.

2. An adjustable RF microwave tuning post as defined in claim 1, wherein said tuning post is provided with integrally-formed bellows axially of said tuning post.

3. A tuning post as defined in claim 2, wherein said bellows are disposed at the top end thereof.

4. A tuning post as defined in claim 2, wherein said bellows are disposed at the bottom end thereof.

5. A tuning post as defined in claim 1, wherein said tuning post is provided with a flexible corrugated top.

6. A tuning post as defined in claim 1, wherein said tuning post is provided with a flexible generally flat top end.

7. A tuning post as defined in claim 6, wherein said tuning post is provided with a plunger-shaped extension above said top end.

8. A tuning post as defined in claim 1, wherein said tuning post is provided with longitudinal bellows extending axially thereof.

9. A tuning post as defined in claim 1, wherein said:

said drive element is a drive shaft extending internally of said tuning post and connected to said tuning post at a top end thereof and connected at the other end of said drive shaft to a tuning nut.

10. A tuning post as defined in claim 1, wherein said means for varying the dimensions of said tuning post is pneumatically driven.

11. A tuning post as defined in claim 1, wherein said means for varying the dimensions of said tuning post is hydraulically driven.

12. A tuning post as defined in claim 1, wherein said means for varying the dimensions of said tuning post is electro-mechanically driven.

13. A tuning post as defined in claim 1, wherein the dimensions of said tuning post vary in response to varying the temperature of the tuning post.

14. A tuning post as defined in claim 9, wherein said drive shaft is threadedly secured at the top end of said tuning post using of threads of one pitch and at bottom end of said tuning post using threads of a second pitch.

15. A tuning post as defined in claim 14, wherein said drive shaft and said top end form a first mechanical stop when said tuning post is fully extended and said drive shaft and said tuning nut form a second mechanical stop when said tuning post is fully retracted.

16. A microwave resonator; comprising:

a chassis bounding an RF cavity;

an adjustable RF microwave tuning post integrally formed with said RF cavity, said tuning post being flexible and hollow and having a continuous conductive body free of any seam or joint;

means for varying and controlling dimensions of said tuning post in said RF cavity, whereby said conductive body of said post reduces passive intermodulation (PM) interference as a result of being integrally-formed and being free of any seam or joint.

17. A tuning post as defined in claim 1, wherein said tuning post has proximal and distal end regions and is elongated, said means for varying and controlling dimensions of said tuning post in said RF cavity including a driving element arranged within confines of the tuning post and arranged to move between extended and retracted positions, the driving element having distal and proximal ends with the distal end being closer to the distal end region of the tuning post than is the proximal end of the driving element, in response to the driving element moving between the extended and retracted positions, the dimensions of said tuning post changing in said RF cavity, a relative distance between said proximal and distal end regions of the tuning post changing in said RF cavity, and the distal end of the driving element moving relative to the distal end region of the tuning post.

18. A microwave resonator as in claim 17, wherein the drive mechanism has a differential thread engagement, the driving element having two areas with threads that are differential.

19. A tuning post as defined in claim 16, wherein said tuning post has proximal and distal end regions and is elongated, said means for varying and controlling dimensions of said tuning post in said RF cavity including a driving element arranged within confines of the tuning post and arranged to move between extended and retracted positions, the driving element having distal and proximal ends with the distal end being closer to the distal end region of the tuning post than is the proximal end of the driving element, in response to the driving element moving between the extended and retracted positions, the dimensions of said tuning post changing in said RF cavity, a relative distance between said proximal and distal end regions of the tuning post changing in said RF cavity, and the distal end of the driving element moving relative to the distal end region of the tuning post.

20. A microwave resonator as in claim 19, wherein the drive mechanism has a differential thread engagement, the driving element having two areas with threads that are differential.

21. A microwave resonator; comprising:

a chassis bounding an RF cavity;

an adjustable RF microwave tuning post integrally formed with said RF cavity, said tuning post being flexible and hollow and having a continuous conductive body free of any seam or joint;

an adjustor arranged to vary dimensions of said tuning post within said RF cavity in response displacement of said adjustor relative to said chassis, whereby said conductive body of said post reduces passive intermodulation (PM) interference as a result of being integrally formed and being free of any seam or joint; and wherein said tuning post is integrally formed with the chassis of said RF cavity and free of seams or joints where the tuning post and the chassis join.

22. A tuning post as defined in claim 21, wherein said tuning post has proximal and distal end regions and is elongated, said adjustor including a driving element arranged within confines of the tuning post and arranged to move between extended and retracted positions, the driving element having distal and proximal ends with the distal end being closer to the distal end region of the tuning post than is the proximal end of the driving element, in response to the driving element moving between the extended and retracted positions, the dimensions of said tuning post changing in said RF cavity, a relative distance between said proximal and distal end regions of the tuning post changing in said RF cavity, and the distal end of the driving element moving relative to the distal end region of the tuning post.

23. A microwave resonator as in claim 21, wherein the adjustor has a differential thread engagement, the driving element having two areas with threads that are differential.

* * * * *